US008464444B2

(12) United States Patent
Bierwith

(10) Patent No.: US 8,464,444 B2
(45) Date of Patent: Jun. 18, 2013

(54) HYDRAULIC LOCKING MECHANISM FOR SECURING TOOTH CARRYING ADAPTERS TO LIPS OF EXCAVATING BUCKETS AND THE LIKE

(76) Inventor: Robert S. Bierwith, Alameda, CA (US)

( * ) Notice: Subject to any disclaimer, the term of this patent is extended or adjusted under 35 U.S.C. 154(b) by 154 days.

(21) Appl. No.: 12/881,997

(22) Filed: Sep. 14, 2010

(65) Prior Publication Data

US 2011/0061271 A1 Mar. 17, 2011

(51) Int. Cl.
*E02F 9/28* (2006.01)

(52) U.S. Cl.
USPC ..... 37/457; 37/455; 172/719; 172/772

(58) Field of Classification Search
USPC ..... 37/455, 456, 457, 458; 172/719, 172/772
See application file for complete search history.

(56) References Cited

U.S. PATENT DOCUMENTS

| | | | | | |
|---|---|---|---|---|---|
| 1,220,186 | A | * | 3/1917 | Chambers | 37/454 |
| 3,012,346 | A | * | 12/1961 | Larsen | 37/457 |
| 3,520,224 | A | * | 7/1970 | Elbert et al. | 411/512 |
| 3,572,785 | A | * | 3/1971 | Larson | 403/374.2 |
| 3,722,932 | A | * | 3/1973 | Dougall | 403/379.4 |
| 3,831,298 | A | * | 8/1974 | Helton et al. | 37/457 |
| 3,891,065 | A | * | 6/1975 | Iijima et al. | 188/41 |
| 4,267,653 | A | * | 5/1981 | Hahn et al. | 37/457 |
| 4,413,432 | A | * | 11/1983 | Bierwith | 37/456 |
| 4,663,867 | A | * | 5/1987 | Hahn et al. | 37/459 |
| 5,134,793 | A | * | 8/1992 | Bierwith | 37/458 |

(Continued)

FOREIGN PATENT DOCUMENTS

| | | |
|---|---|---|
| CA | 2 028 403 C | 8/2000 |
| MX | PA04001316 A | 2/2005 |

(Continued)

OTHER PUBLICATIONS

Australian Office Action mailed on Feb. 16, 2012 for AU Patent Application No. 2010219431, 2 pages.

(Continued)

*Primary Examiner* — Jamie L McGowan
(74) *Attorney, Agent, or Firm* — Kilpatrick Townsend & Stockton LLP

(57) ABSTRACT

A connection for firmly securing an adapter for detachably carrying a replaceable digging tooth at its front end to a lip of an excavating container of excavating equipment. The adapter has an upper leg and a lower leg located proximate respective upper and lower surfaces of the lip. The connection has substantially aligned openings in the legs and the lip, and engagement sections of the adapter legs traverse the opening in the lip proximate and forward of an aft end thereof. A pressure applying unit, such as a hydraulic actuator, is arranged inside the opening and generates a generally horizontally acting force which draws the adapter and the lip towards each other. A stress member, which can be a C-clamp, is operatively coupled to the hydraulic actuator and resiliently deforms relative to its relaxed shape when it is subjected to the horizontally acting force. A spacer, such as a wedge, is inserted between the hydraulic actuator and the openings while the horizontally acting force resiliently deforms the stress member. The wedge is shaped so that upon a reduction or cessation of the horizontally acting force the stress member, e.g. the C-clamp, remains in the resiliently deformed state in which it draws the adapter and the lip towards each other and keeps them immovably secured to each other until the wedge can be withdrawn following a repressurization of the hydraulic actuator.

22 Claims, 9 Drawing Sheets

U.S. PATENT DOCUMENTS

| | | | | |
|---|---|---|---|---|
| 5,311,681 | A * | 5/1994 | Ruvang et al. | 37/457 |
| 5,465,512 | A * | 11/1995 | Livesay et al. | 37/457 |
| 5,743,031 | A * | 4/1998 | Launder et al. | 37/455 |
| 5,806,215 | A * | 9/1998 | Matthews | 37/452 |
| 5,926,982 | A * | 7/1999 | Keech et al. | 37/455 |
| 5,983,534 | A * | 11/1999 | Robinson et al. | 37/459 |
| 6,032,390 | A * | 3/2000 | Bierwith | 37/456 |
| 6,151,812 | A * | 11/2000 | Bierwith | 37/455 |
| 6,209,238 | B1 | 4/2001 | Ruvang | |
| 6,588,965 | B1 * | 7/2003 | Keech et al. | 403/31 |
| 6,986,216 | B2 * | 1/2006 | Emrich et al. | 37/450 |
| 7,219,454 | B2 | 5/2007 | Maher | |
| 7,299,570 | B2 * | 11/2007 | Emrich et al. | 37/455 |
| 7,730,652 | B2 * | 6/2010 | McClanahan et al. | 37/455 |
| 7,862,277 | B2 * | 1/2011 | Dingwall et al. | 411/351 |
| 7,997,017 | B2 * | 8/2011 | McClanahan et al. | 37/455 |
| 8,104,200 | B2 * | 1/2012 | Briscoe | 37/455 |
| 2004/0060209 | A1 | 4/2004 | Watanabe | |
| 2007/0051022 | A1 * | 3/2007 | Meyers et al. | 37/455 |
| 2011/0258891 | A1 * | 10/2011 | Ruvang | 37/455 |

FOREIGN PATENT DOCUMENTS

| | | | |
|---|---|---|---|
| WO | 99/58773 | A1 | 11/1999 |
| WO | 01/25551 | A1 | 4/2001 |
| WO | 2005-066422 | A2 | 7/2005 |
| WO | 2005-066422 | A3 | 7/2005 |
| WO | 2008/140878 | A1 | 11/2008 |

OTHER PUBLICATIONS

Australian Notice of Acceptance mailed on Jun. 5, 2012 for AU Patent Application No. 2010219431, 3 pages.

Canadian Office Action mailed on Apr. 19, 2012 for CA Patent Application No. 2,714,471, 4 pages.

Chilean Office Action received on Aug. 17, 2012 for CL Patent Application No. 0976-10, 8 pages.

* cited by examiner

HYDRAULIC LOCKING MECHANISM FOR SECURING TOOTH CARRYING ADAPTERS TO LIPS OF EXCAVATING BUCKETS AND THE LIKE

BACKGROUND OF THE INVENTION

Ground-moving and excavating equipment employs shovels, buckets and the like with which earth, gravel, rock formation and the like are excavated and moved around. Typically, such buckets carry a lip along their digging edges, and the lips in turn mount the digging teeth.

The digging teeth and their connections to the lips of the buckets are subject to the most wear and tear of the entire bucket because they are exposed to constant abrasion, impacts and the like. As a result, they require frequent replacement. Replacing the teeth in accordance with the prior art is relatively time-consuming, and the excavating equipment must sit idle during that time, which is undesirable because it ultimately reduces profits.

There are presently many variations of how the teeth are attached to the adapters and the adapters are in turn attached to the lips of the buckets or shovels. U.S. Pat. Nos. 4,413,432, 6,032,390, 6,216,368 and 6,668,472, for example, disclose different approaches for securing teeth to the adapters and/or the adapters to the lip.

The present invention is particularly directed to the manner in which the adapters are secured to the lips or other members of a wide variety of containers used in ground-handling equipment, such as loaders, shovels, buckets, dragline buckets and the like.

BRIEF SUMMARY OF THE INVENTION

Generally speaking, the present invention secures an adapter to the front edge of a container or bucket, or a lip carried by the container. A connection is provided for firmly securing an adapter that detachably carries a replaceable digging tooth at its front end to the lip of an excavating container of excavating equipment, such as, for example, a loader, a shovel, a dragline bucket or the like. The adapter has an upper leg and a lower leg located proximate respective upper and lower surfaces of the lip. The connection employs substantially aligned openings in the legs and the lip, and engagement sections of the adapter legs traverse the opening in the lip proximate and forward of an aft end thereof. A pressure applying unit is arranged inside the openings and generates a generally horizontally acting force which draws the adapter and the lip towards each other. A stress member is operatively coupled to the pressure applying unit and resiliently deforms relative to its relaxed shape when the stress member is subjected to the horizontally acting force. Further, a spacer is inserted between the pressure applying unit and the openings while the horizontally acting force resiliently deforms the stress member. The spacer is further shaped so that upon a reduction or cessation of the horizontally acting force the spacer continues to maintain the stress member in a resiliently deformed state in which it draws the adapter and the lip towards each other.

In one embodiment of the invention, generally oblong, vertically oriented, aligned slots are provided in the adapter with a similarly vertically oriented slot in the bucket or lip (hereafter usually referred to as "lip"). The stress member is formed by a C-clamp with a main body from which a pair of arms perpendicularly extend. The C-clamp is inserted into the aligned holes formed by the adapter and the lip so that the arms of the clamp engage generally rearwardly extending, typically inclined, ramps defined by an aft section of the adapter.

The forward facing side of the main body of the C-clamp is flat and vertical. The clamp is further constructed so that the rearwardly facing side of the main body is spaced apart from the adjacent hole wall in the adapter through which the C-clamp extends.

A pressure applying unit in the form of a hydraulic actuator with at least one and preferably a plurality of, e.g. two, hydraulically actuated pistons is inserted into the aligned holes so that the pistons face the vertical, forward facing or front side of the main C-clamp body. The front side of the pressure applying unit extends in a vertical direction past the end of the hole in the lip and is supported by and positioned on the lip proximate the forward end thereof.

The rearwardly facing or aft surface of the pressure applying unit, past which the pistons can be extended, and which faces the vertical front side of the main C-clamp body, is angularly inclined relative to the vertical and diverges in a downward direction relative thereto. As a result, following placement of the C-clamp and the pressure applying unit into the substantially aligned holes in the lip and the adapter, a downwardly converging, wedge-shaped space is formed between the inclined aft surface of the pressure applying unit and the vertical front side of the C-clamp.

The spacer, in the form of a wedge, has a flat, vertical rearwardly facing aft surface that mates with the vertical front side of the C-clamp. The opposite front side of the wedge forms a serrated surface that is complementary to the correspondingly serrated aft surface of the pressure applying unit. The serrated front surface of the wedge is angularly inclined relative to its flat aft surface and converges in a downward direction to define the wedge, which is shaped so that it substantially corresponds to the wedge-shaped space between the front side of the C-clamp and the aft side of the pressure applying unit.

The wedge is fork-shaped, and the portion thereof overlying the piston or pistons in the pressure applying unit remains open so that the pistons can be moved rearwardly from the pressure applying unit into engagement with the vertical front side of the C-clamp.

In use, after the C-clamp and the pressure applying unit have been slipped over and engage the adapter and the lip, respectively, the wedge is inserted into the wedge-shaped space between the C-clamp and the pressure applying unit.

To secure the adapter to the lip, the hydraulic actuators are energized to move the pistons rearwardly into engagement with the vertical front side of the C-clamp. As the pressure in the hydraulic actuators increases by applying as much as 10,000 psi, which, in a presently preferred embodiment of the invention, generates a force of about 50 tons, the main body of the C-clamp is deflected in the aft direction. This in turn resiliently stresses the C-clamp and spreads its arms apart, which increases the spacing between them so that the force applied by the pistons forces the C-clamp in the aft direction relative to the adapter engaged by the C-clamp arms.

The applied force also elongates the holes in the lip and the adapter, which also causes some resilient elongation of the length of the openings in the adapter.

As a result of the foregoing, the downwardly converging space between the C-clamp body and the pressure applying unit becomes larger in a generally horizontal direction and allows the wedge to further drop downwardly into that space.

When the hydraulic pressure in the actuator which defines the pressure applying unit is relieved, the built-up stresses in the resiliently deflected C-clamp push the actuator via the wedge forwardly into rigid engagement with the lip, while the resiliently deflected arms of the C-clamp remain in forced engagement with the adapter since the wedge remains fixed between the C-clamp and the pressure applying unit. The interlocking serrations of the pressure applying unit and the wedge prevent the latter from moving upwardly out of the wedge-shaped space between the pressure applying unit and the C-clamp.

Although it is preferred that the vertical aft side of the C-clamp remains spaced apart from the proximate aft wall of the opening in the adapter, it is possible to use the arrangement without such spacing. In such an event, the C-clamp is locked in place and instead of the C-clamp being resiliently stressed, the metal of the adapter and the lip become tension-stressed in the horizontal direction to open up the wedge-shaped space between the C-clamp and the hydraulic actuator. When the pressure on the pistons of the actuator is relieved, the stressed portions of the adapter and the lip move a slight distance back towards their relaxed state until the wedge between the C-clamp and the hydraulic actuator blocks further contractions by the lip and the adapter, thereby locking the wedge in place and maintaining the stress-induced force, which tends to move the lip and the adapter towards each other.

Another embodiment of the present invention is particularly well-adapted for use with dragline buckets of dragline excavating equipment. Thus, this embodiment provides a connection for firmly securing the adapter for detachably carrying a replaceable digging tooth at its front end to the lip of an excavating container, e.g. a dragline bucket. The connection has substantially aligned openings in the legs and the lip, and engagement sections of the adapter legs traverse the opening in the lip proximate and forward of the aft end of the opening. The upper and lower legs of the adapter extend from proximate a front end of the lip at inclined angles relative to the respective upper and lower surfaces of the lip. As a result, the opening in the lip and the openings in the adapter legs are non-contiguous. A pressure applying unit, again preferably a hydraulic actuator, is arranged inside the openings and configured to selectively apply and release a generally horizontally acting force which draws the adapter and the lip towards each other. A wedge is arranged in the openings, converges in a vertical, typically downward, direction, and is disposed between and in contact with an inclined side of the hydraulic actuator, preferably its front side, and the vertical front wall of the opening in the lip, which together define a wedge-shaped space that receives the wedge.

The hydraulic actuator has at least one power-actuated piston that is extendable and retractable in a generally horizontal direction through the wedge-shaped space for applying the generally horizontally acting force to the upper and lower legs of the adapter. This enlarges a horizontal extent of the wedge-shaped space and resiliently elongates the upper and lower adapter legs, which places the legs in a stressed state. The wedge placed in the wedge-shaped space has a horizontal dimension selected so that when it is inserted into the wedge-shaped space while the hydraulic actuator applies the horizontally acting force, the adapter legs are and remain in their stressed state even if the pressure acting in the pistons is reduced or ceases altogether as generally described above, thereby maintaining the lip and the adapter in firm, immovable contact with each other.

As stated, the pressure applying unit will normally be a hydraulic actuator, and it preferably comprises a housing that extends through at least a portion of the openings in the adapter and the lip in a generally vertical direction. The housing defines an interior cavity inside of which at least one and preferably two hydraulic pistons are movable in a generally horizontal direction for placing the stress member in its stressed state. A pressure conduit extends from the cavity to a vertical end, preferably the upper end, of the housing for pressurizing and depressurizing the cavity, which extends the pistons out of and retracts them into the cavity. A pressure fitting adapted to be connected to a source of a pressurized fluid communicates with the conduit and extends to an exterior of the housing, where a metal cap covers the vertical (e.g. upper) end of the housing to encapsulate the pressure fitting and protect it from debris and against heavy impacts which might damage the fitting and render it inoperative. The cap is removably secured to the housing, preferably with at least one detent member in either the housing or the cap and a depression cooperating with the detent member in the other one of the housing and the cap. The detent member is spring-biased into the depression when the cap is placed over the vertical end of the housing and retains the cap on the housing with a force selected so that the cap can be manually removed from the housing to provide access to the pressure fitting.

To enable removal of the protective cap in the event it became damaged in use and can no longer be manually removed, the housing preferably includes a generally horizontally oriented support surface proximate the vertical (e.g. upper) end of the housing. The cap extends in a vertical direction past this support surface and defines a cut-out positioned proximate the support surface and shaped to be engaged by a prying tool that is configured to rest on the support surface while it engages the cut-out so that the cap, when jammed, can be pried off the housing with a suitable prying tool.

DETAILED DESCRIPTION OF THE INVENTION

Figure 1:
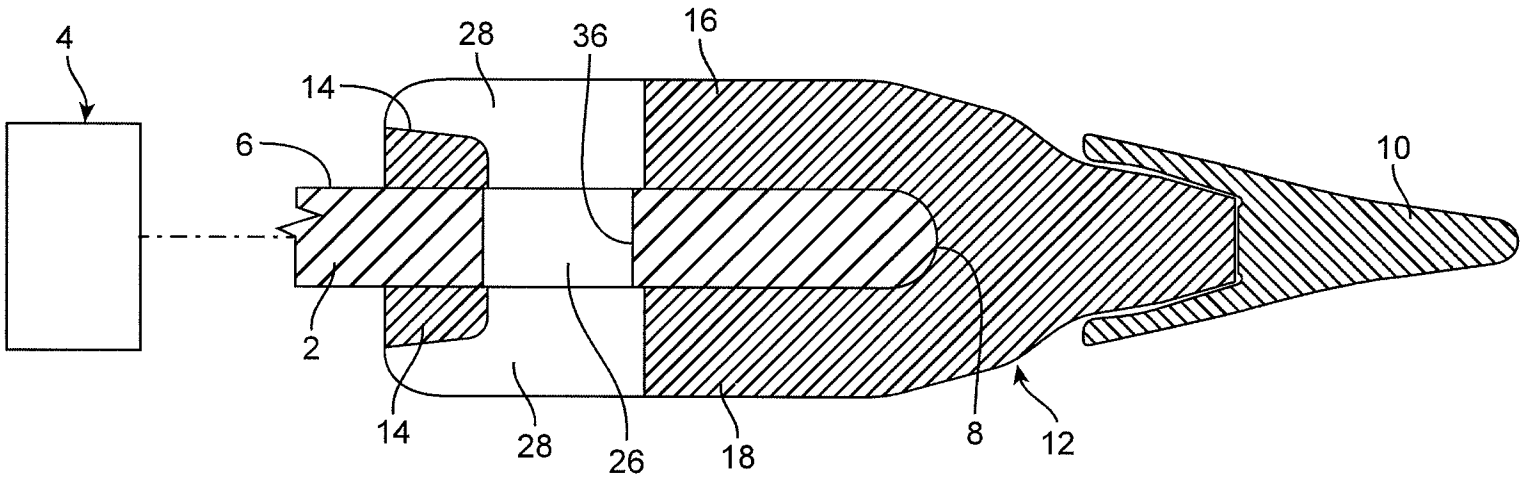
FIG. 1 schematically illustrates an excavating unit to which an excavating bucket having a front lip, an adapter overlying the lip and digging teeth are secured.

Referring to FIG. 1, by way of background, a bucket, shovel or the like 2 (hereafter sometimes also more generally referred to as "container") is conventionally attached to a piece of excavating equipment 4. A front lip 6 is normally separately attached in any one of a variety of manners to the bucket, but which can also be formed by the bucket itself should that be desired. The lip defines a front edge 8 of the bucket. Digging teeth 10 are spaced apart across the width of the bucket and project from the lip in the forward, travel direction of the excavating equipment. An adapter 12 is interposed between each tooth and the bucket lip. Each adapter has a front end to which the tooth is typically replaceably attached and an aft portion 14 defined by upper and lower legs 16, 18, respectively, which overlie respective upper and lower surfaces 20, 22 of the bucket lip and can be slipped onto the lip.

The bucket teeth are subject to heavy wear and rough treatment and therefore require frequent replacement. The adapters holding the teeth are also subject to heavy wear and rough treatment and therefore also require frequent replacement. To allow replacement of the adapter, it is releasably secured to the bucket lip 6 by a connection 24 (not shown in FIG. 1) constructed in accordance with the present invention as is described below.

A widely used connection of this type is the so-called Whistler connection that employs a C-clamp which extends through aligned openings in the legs 16, 18 of the adapter and lip 6. By applying a horizontal, rearwardly directed force against the C-clamp, its arms press the adapter against the upper and lower surfaces of the lip and thereby lock the two to each other. To prevent a loosening of the lock, a variety of releasable locking devices are used that in one manner or another employ wedged surfaces that maintain the C-clamp in engagement and lock it in place to prevent the clamp from becoming loose.

Keeping down-time of the excavating equipment to a minimum, prior art connections employed locking members that could normally be reasonably quickly released to allow the replacement of the worn adapter. However, in the course of replacement those parts of the connection became damaged and had to be replaced at significant cost.

Figure 2:
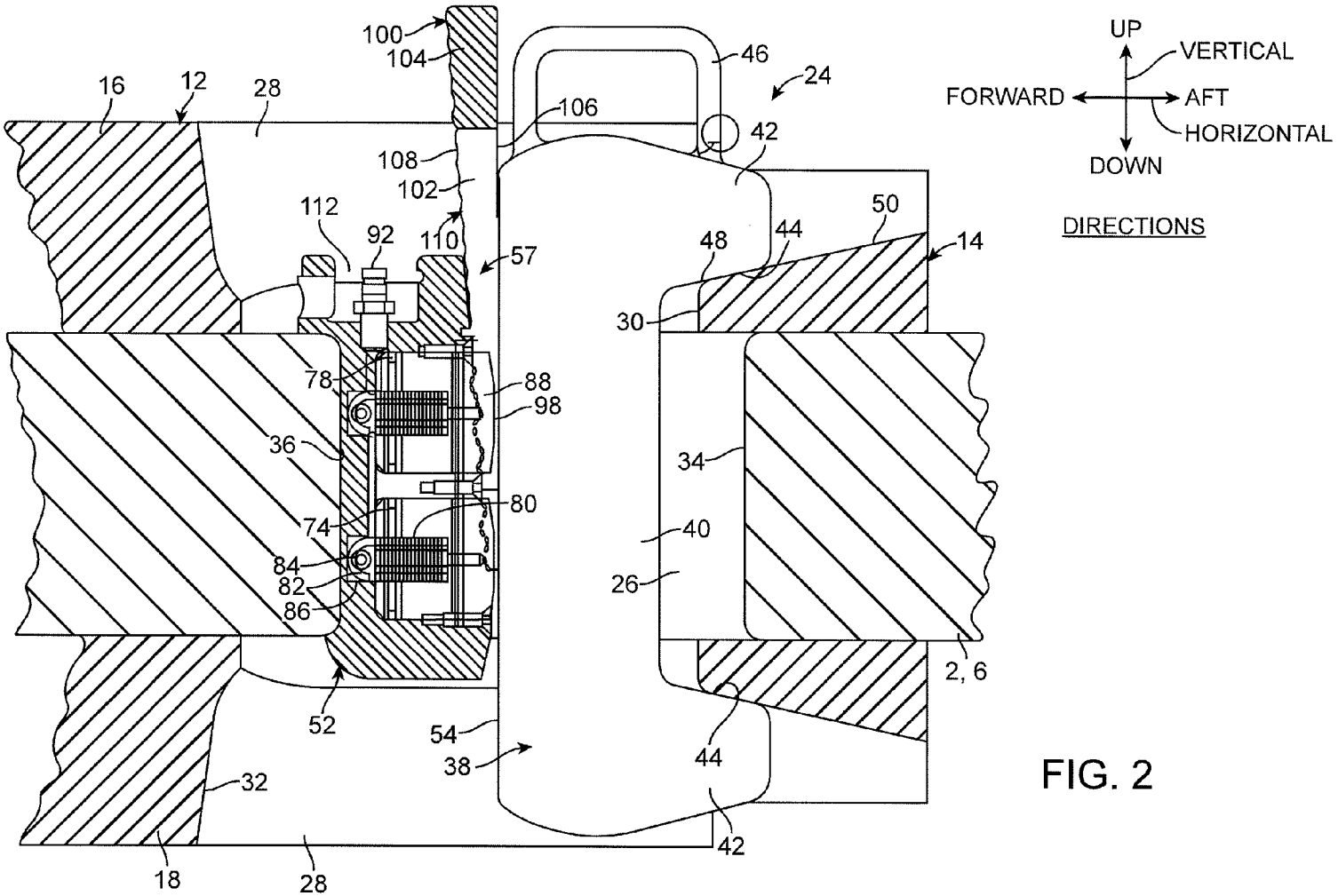
FIG. 2 is a side elevational view, in section, showing the hydraulic lock of the present invention.
Figure 3:
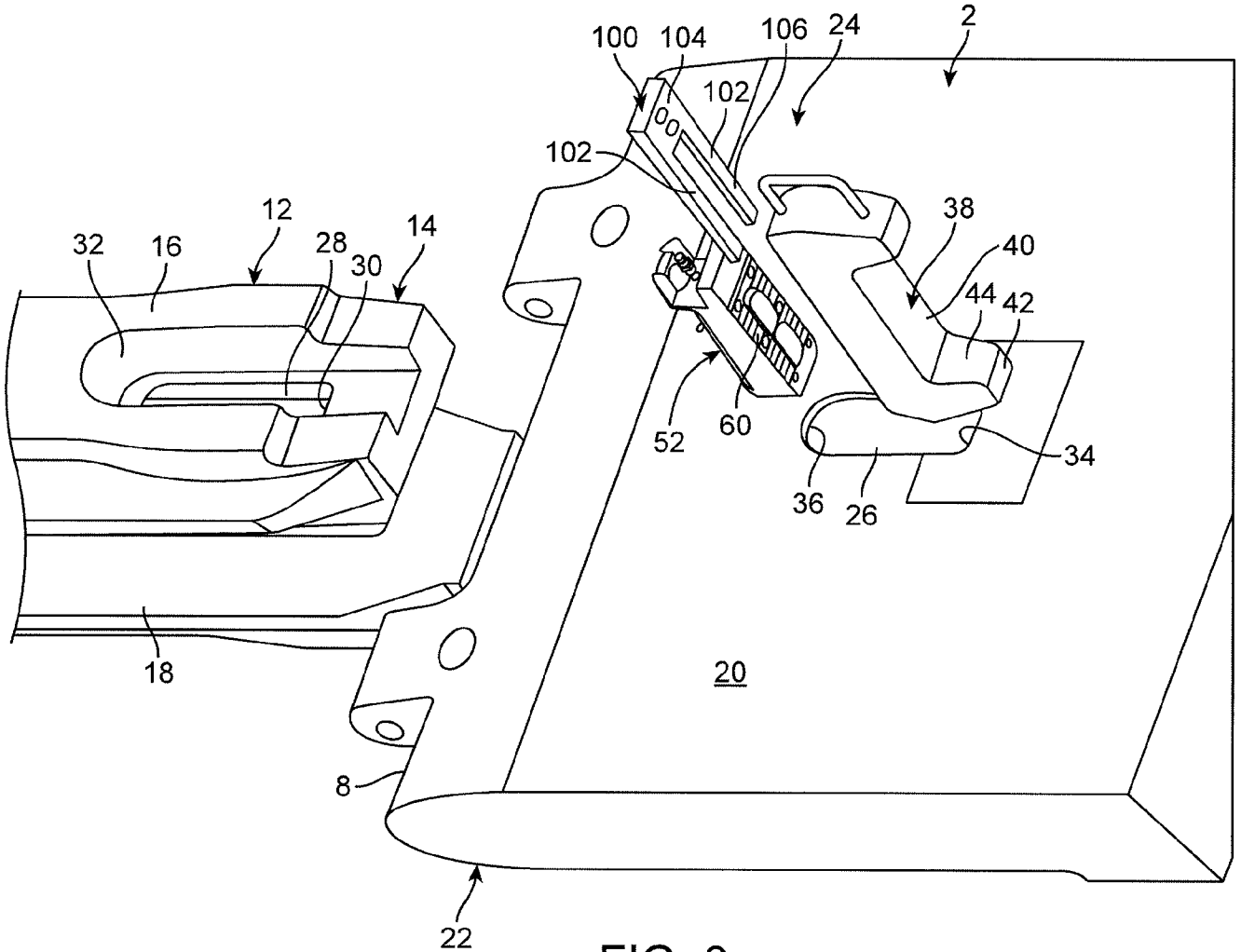
FIG. 3 is an exploded, perspective view separately illustrating the components of the hydraulic lock shown in FIG. 2.

Referring now to FIGS. 2 and 3, in one preferred embodiment, a connection 24 constructed in accordance with the present invention positions the upper and lower legs of the adapter over lip 6 so that respective vertical openings 26 and 28 in the lip and the legs of the adapter overlie each other. As is well-known in the art and illustrated in the drawing figures, the aft and front ends 30, 32 of the adapter are located forward of the aft and front ends 34, 36 of the hole in the lip when the front edge 8 of the lip engages the adapter while maintaining an open passage extending through both openings through which the components of connection 24 are inserted as described in the following.

A C-clamp 38 has a main body 40 that extends through the openings in the adapter legs and the lip and a pair of arms 42 that extend rearwardly from the main body. Engagement surfaces 44 are defined by surfaces of the arms that face each other, diverge in an aft direction and form a taper relative to the horizontal in the aft direction. A vertical end of the C-clamp is preferably provided with a handlebar 46.

With the C-clamp in its relaxed, unstressed state, it is moved rearwardly so that the opposing engagement surfaces 44 on the arms of the C-clamp engage a preferably slightly rounded edge 48 of the aft portion of the adapter at a point spaced from respective forward and aft ends of engagement surfaces 44. Edge 48 is generally defined by the intersection of aft surface 30 of the hole in the adapter and a tapered surface 50 of the adapter surface. The latter preferably has substantially the same angle of inclination relative to the horizontal as the engagement surfaces on the C-clamp arms.

A pressure applying unit 52 is next inserted into the holes extending through the adapter and the lip between a vertical, front surface 54 of the C-clamp and front surface 36 of hole 26 in the lip.

Figure 4:
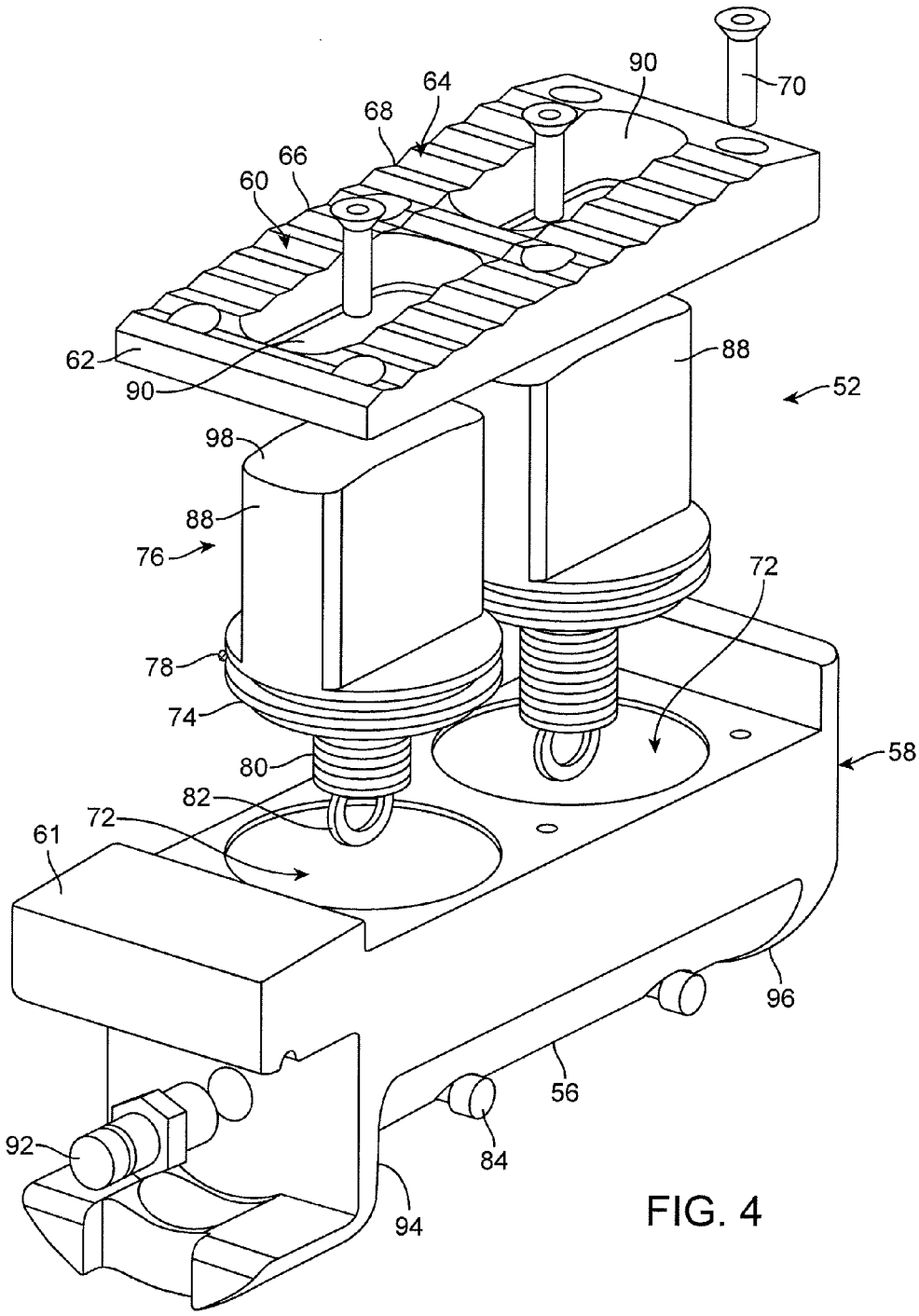
FIG. 4 is a perspective, exploded view of a hydraulic actuator and a serrated face thereon employed by the present invention.
Figure 5:
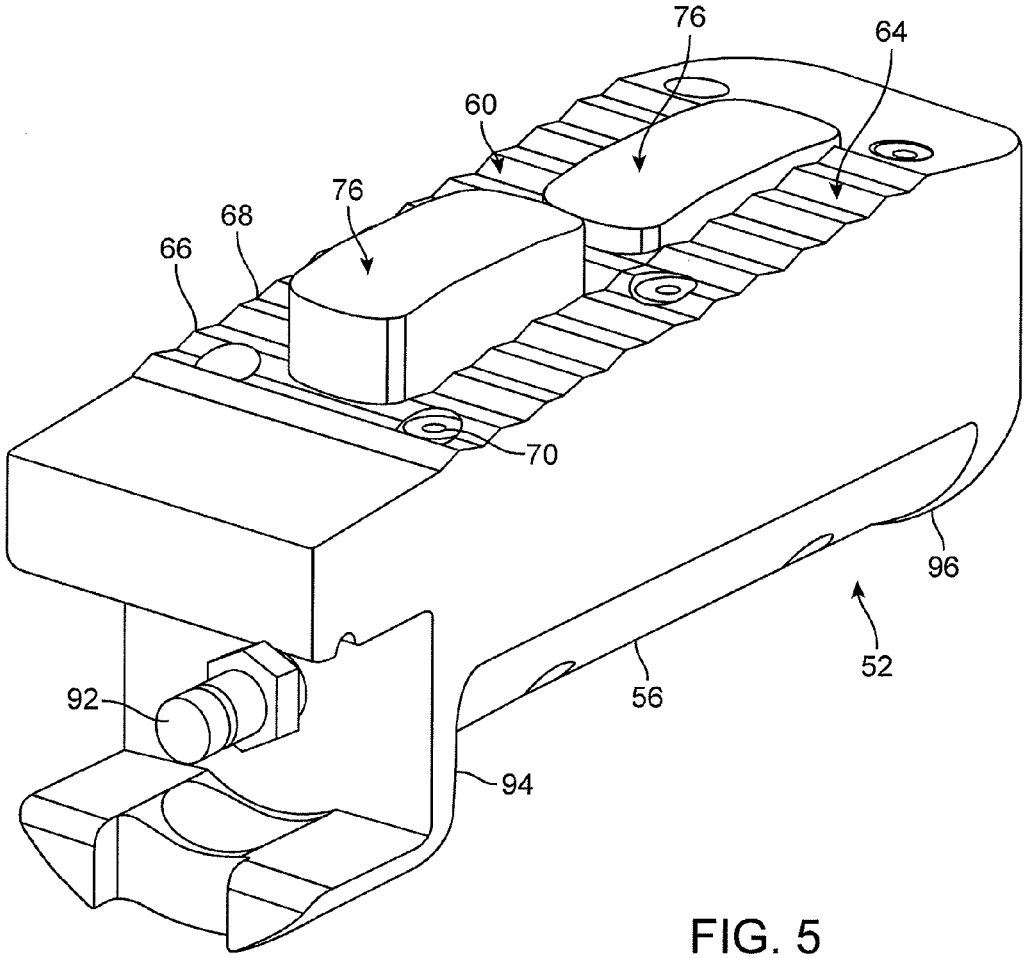
FIG. 5 is a perspective view of the hydraulic actuator in its assembled state.
Figure 6:
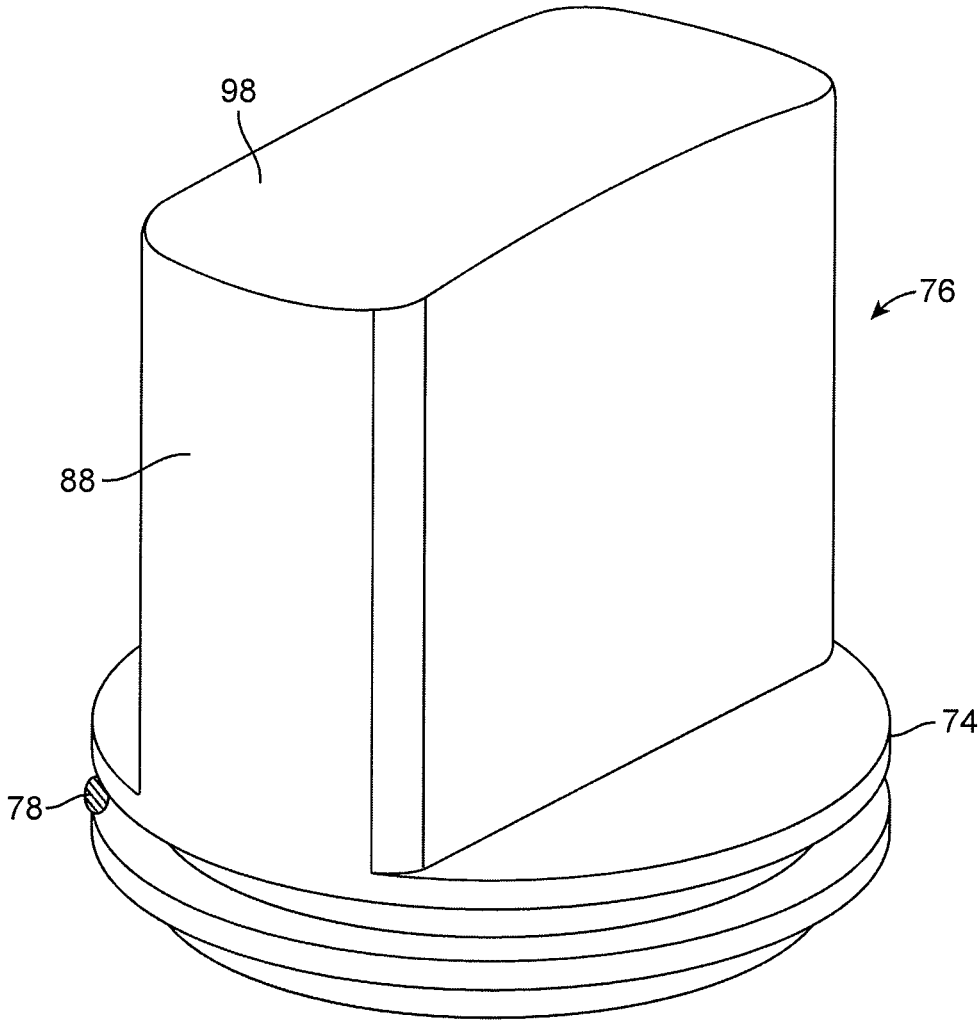
FIG. 6 is a perspective view of a piston employed in the hydraulic actuator shown in FIG. 5.

Referring now to FIGS. 2, 4 and 5, pressure applying unit 52 is preferably a hydraulic actuator that has a main body 58 that defines a front surface 56 which is in abutment with front surface 36 of hole 26 in the lip and an aft surface 60 formed in part by the main body and in part by a plate 62 with undulations 64 that extend in a horizontal direction across the width of the plate and form smooth, alternating ridges 66 and valleys 68. Screws 70 releasably secure plate 62 to main body 58. The portion 61 of aft surface 60 defined by the main body 58 is recessed relative to the undulations in plate 62 and smooth, that is, free of undulations, as best seen in FIG. 5.

Front surface 56 of the hydraulic actuator is vertically oriented parallel to the front surface 36 in lip opening 26, while aft surface 60 converges at an angle to the vertical towards front surface 54 of C-clamp 38 in a downward direction to define a wedge-shaped space 57 between the two that converges in a downward direction.

On its inside, body 58 forms a pair of spaced-apart cylinder openings 72 that movably houses a disc-shaped flange 74 of a hydraulic piston 76. Each flange includes an O-ring 78 to seal the piston as it reciprocates inside the cylindrical opening. A tension spring 80 has an inner hook 82 that is anchored to a bolt 84 that extends across the cylindrical opening formed in a depression 86 extending from the closed end of the cylindrical opening as is illustrated in FIG. 2.

Pushers 88, which are an integral part of piston 76, preferably have a generally rectangular cross-section and extend from piston flanges 74 in the aft direction through openings 90 in plate 62 with sufficient play so that the pushers can reciprocate through the openings.

Hydraulic actuator 52 further includes a high pressure fitting 92 that is in fluid communication with the interior of cylinder openings 72. When high pressure hydraulic fluid is applied to the fitting via a suitable pressure hose (not shown) connected to a source of high pressure, presently preferably capable of applying a pressure of at least 10,000 psi, pistons 76 move against the tension force exerted by springs 80 in the aft direction so that pushers 88 move past the openings 90 in plate 62 towards front side 54 of the C-clamp. Conversely, by reducing or ceasing entirely the pressure applied to the interior of cylindrical openings 72, the tension of springs 80 retracts the pistons so that the ends of pushers 88 project only slightly, or not at all, out of openings 90 in the plate.

Hydraulic actuator 52 is inserted into the approximately aligned openings 26, 28 through the lip and the adapter, and the front surface 56 of the actuator abuts the front surface 36 of the hole through the lip. Flanges 94, 96 at upper and lower ends of actuator body or housing 58 center the actuator relative to opening 26 through the lip. Hydraulic pressure is then applied via fitting 92 into the interior of cylinders 72 to push pistons 76 rearwardly until force transmission surfaces 98 at the ends of pushers 88 engage front surface 54 of the C-clamp and in particular that section of main C-clamp body 40 which is inside hole 26 through the lip.

In a presently preferred embodiment of the invention, adapted for use with connections for a wide variety of sizes of bucket lips, adapters and C-clamps, the hydraulic cylinders are dimensioned so that the two pistons 76 exert a combined force of about 50 tons against the aft side of the C-clamp. This force deflects the main body of the most commonly used C-clamps rearwardly, which in turn causes arms 42 of the C-clamp to spread apart, thereby increasing the spacing between them and causing the pushers 88 of the pistons to move the C-clamp in an aft direction relative to the tapered surface 50 at the aft portion of adapters 12.

With the pistons moved rearwardly as far as possible under the applied force generated by the hydraulic pressure in the cylinders, a forked wedge 100 is dropped into the wedge-shaped space 57 between the forward surface 54 of the C-clamp and aft surface 60 of hydraulic actuator 52.

As is best seen in FIGS. 2 and 3, the wedge has a width about equal to the width of hydraulic actuator body 58 and is defined by a pair of spaced-apart legs 102 which, at their upper ends, are joined by a top section 104 of the wedge. The open space between the legs is greater than the width, as measured in the horizontal direction, of pushers 88 so that the legs straddle the pushers and the latter can extend rearwardly in the horizontal direction past the thickness of the C-clamp.

An aft surface 106 of the wedge is flat, while a front surface 108 thereof is inclined relative to the vertical and converges relative to the aft surface of the wedge in a downward direction. It is further dimensioned so that the wedge can be dropped into the wedge-shaped space 57 between aft surface 60 of the hydraulic actuator and front surface 54 of the C-clamp. Further, the front surface of the wedge has horizontally extending undulations or serrations 110 which correspond to the undulations 64 in actuator plate 62. The thickness of the wedge is such that it can be dropped into the wedge-shaped space 57 when the pistons are under pressure and so that the wedge will not permit the C-clamp to return to its unstressed, relaxed state when pressure in the hydraulic actuator is reduced or ceases.

With pistons 76 in actuator 52 energized, wedge 100 is dropped into the space between the hydraulic actuator and the front surface of the C-clamp as far as possible, preferably by manually pushing the top 104 of the wedge downwardly as far as possible until it comes to rest at a location relative to the actuator where the undulating surfaces of the wedge and the actuator are in engagement, that is, where the ridges of one engage the valleys of the other. The relative dimensions of the opposing, undulating surfaces are selected relative to the maximum rearward deflection of the main C-clamp body while pressure is applied to the hydraulic cylinders so that, upon the release of the pressure, the deflected main body of the C-clamp can, at the most, return over only a small proportion of its total deflection back towards its relaxed state before its arms firmly engage and are prevented from further movement in the forward direction by the hydraulic actuator housing 58 and wedge 100 interposed between them. The wedge thereby becomes locked in position by the interengaged undulations on the hydraulic actuator and the wedge and is prevented from vertically moving inside the hole through the lip and the adapter legs.

Following the completion of the connection 24 in the just-described manner, a protective, resilient cap, e.g. made of rubber or the like (not shown), can be placed over the free end of pressure fitting 92. It is additionally preferred to place a metal cover (not shown in FIGS. 2-6) over the open space 112 at the upper end of actuator 52.

When it is time to replace a worn adapter 12 with a new one, the just-described metal cap and/or rubber cover are removed from the top of fitting 92, a pressure hose is connected to the fitting, and the hydraulic cylinders are pressurized to move pistons 76 rearwardly and deflect the main body 40 of the C-clamp in the aft direction as aforedescribed in connection with the installation of a new clamp onto the lip. This deflection of the main body in the aft direction enlarges the wedge-shaped space 57 between the opposing surfaces of the actuator and the clamp to its original, maximum extent. The wedge is thereby loosened so that the opposing undulations on the wedge and the actuator become disengaged. This permits the wedge to be manually pulled out of the wedge-shaped space 57.

This opening of connection 24 is rapidly accomplished by simply applying pressure to the actuator and causes no damage to the C-clamp, the wedge or the hydraulic actuator because all relative movements between the three parts are conducted while the energized pistons 74 keep the wedge-shaped space 57 sufficiently wide to permit sliding the wedge in and out of the opening without requiring hammer blows, crunching turning movements of a screw or the like between any two or more of these parts.

Thus, while the initial cost of the connection, and in particular of the pressure applying unit, e.g. including the hydraulic actuators, is greater than the initial costs of many prior art connections, the much greater speed with which the connection of the present invention can be set and released greatly reduces the excavation equipment down-time required for replacing adapters on container lips, which in and of itself provides significant cost savings. Additional, significant cost savings result from the reusability of the three principal components that form the connection.

Figure 7:
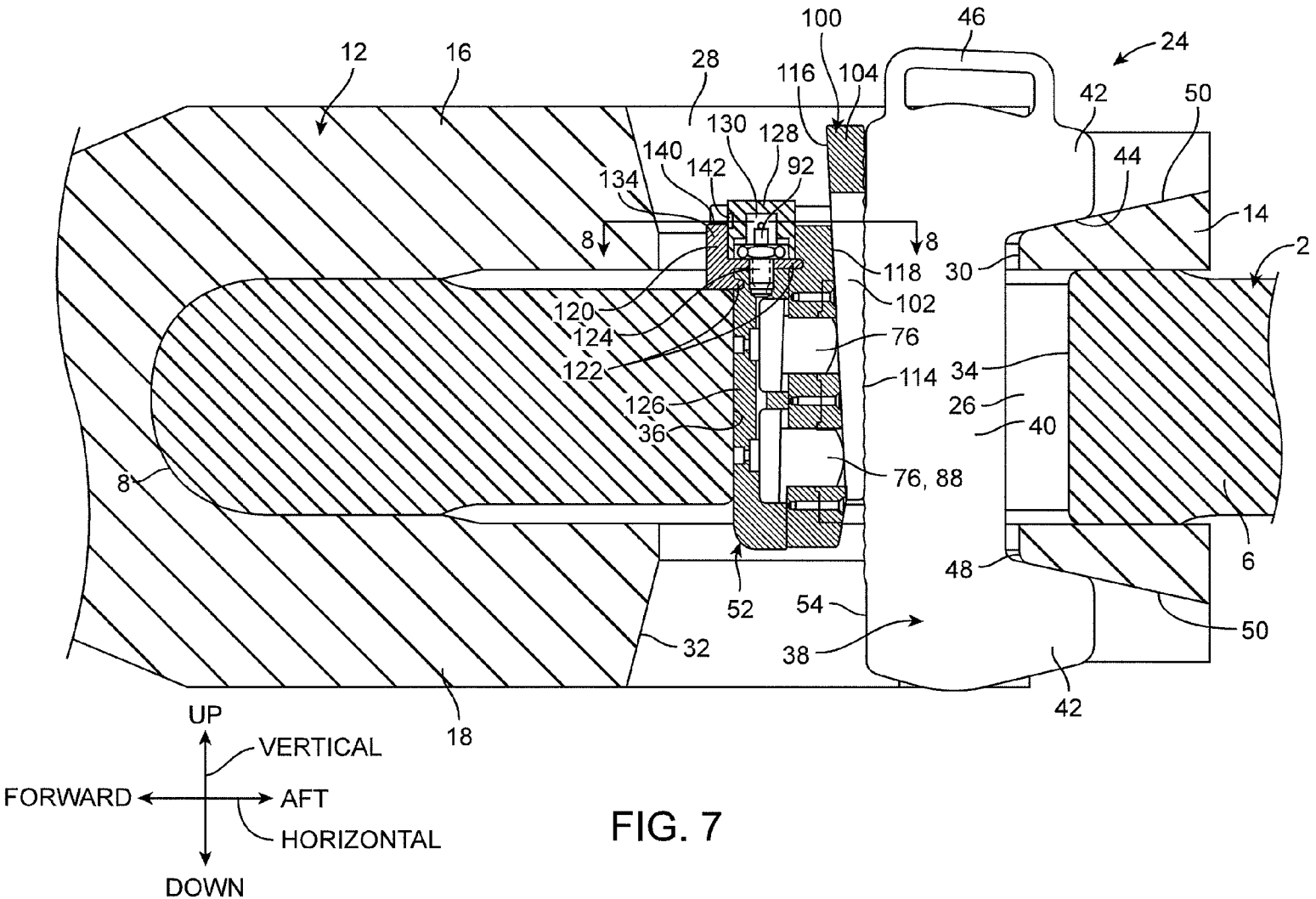
FIG. 7 is a perspective, side elevational view, in section, similar to FIG. 2 and illustrates an alternative embodiment of the present invention.
Figure 8:
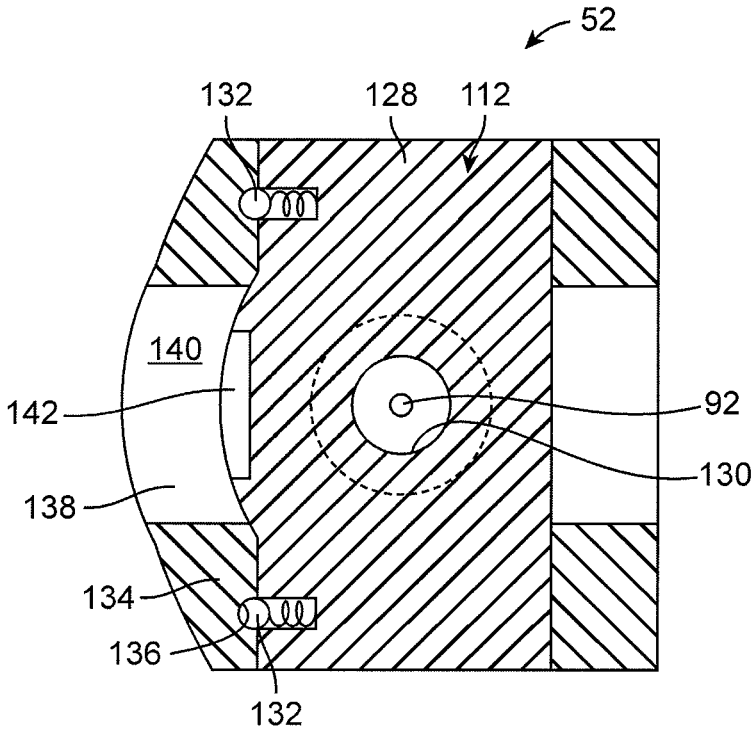
FIG. 8 is a plan view, in section, and is taken on line 8-8 of FIG. 7.

Referring now to FIGS. 7 and 8, in an alternative embodiment of the present invention there are no horizontal undulations between the pressure applying unit, e.g. of hydraulic actuator 52, and wedge 100. In this embodiment, horizontal undulations 114, which correspond to serrations 64 shown in FIGS. 2-6, are formed on front surface 54 of C-clamp 38 and the side of wedge 100 facing it, as illustrated in FIG. 7. Front surface 54 of the C-clamp and the matching surface of the wedge are vertically oriented. A front surface 116 of wedge 100 tapers in a downward direction relative to its side facing front surface 54 of the C-clamp, and the wedge is disposed in a wedge-shaped space defined by the front surface of the C-clamp and a downwardly converging but otherwise flat surface 118 of the hydraulic unit.

To secure the connection 24 shown in FIG. 7, C-clamp 38 is inserted in openings 26, 28 as earlier described so that its arms 42 contact engagement surfaces 44 of the adapter. The hydraulic actuator is positioned at the front end of the overlapping holes 26, 28 in the lip and the adapter, and wedge 100 is inserted in the wedge-shaped space (not separately numbered in FIG. 7) between front surface 54 of the C-clamp and the aft, tapered surface 118 of the hydraulic actuator. The wedge is placed so that its serrations 114 face the corresponding serrations on the front surface 54 of the C-clamp.

Thereafter a hydraulic pressure conduit, such as a hose (not shown), is connected to pressure fitting 92, and pistons 76 of the hydraulic actuator are energized to move them in a horizontally aft direction until they engage the main body of the C-clamp and prestress it as was described earlier, thereby resiliently deforming the C-clamp, which enables it to be further pushed in an aft direction onto the sloping engagement surfaces 50 of the adapter. While the pistons are energized, wedge 100 is manually pushed down into the enlarged wedge-shaped space between the front surface of the C-clamp and the hydraulic actuator and, thereafter, the pressure on the hydraulic pistons is released. Upon release of the pressure, the resiliently deformed C-clamp returns a short distance towards its relaxed condition but remains locked in place by wedge 100 in a prestressed state in which the C-clamp continues to exert a force drawing lip 6 and adapter 12 towards each other and continues to firmly engage the adapter as described above.

To loosen the connection, the hydraulic actuator is reenergized sufficiently to widen the wedge-shaped space between the C-clamp and the actuator so that wedge 100 can be manually withdrawn. Thereafter, upon the depressurization of the hydraulic actuator, the C-clamp returns to its relaxed, stress-free position, enabling a withdrawal of the C-clamp and the hydraulic actuator for replacing the adapter with a fresh one, as was described in more detail above.

The constructional details of the internal components of the hydraulic actuator 52 shown in FIG. 7 were described earlier and are not here repeated again. It is sufficient to state that internally the hydraulic actuator has preferably two spaced-apart pistons 76 which are drawn into a retracted position by tension springs (not shown in FIG. 7). Upon introducing pressurized fluid into the hydraulic actuator, pistons 76 are forced in an aft direction into engagement with front surface 54 of C-clamp 38 to prestress the C-clamp and engage the adapter with arms 42 of the C-clamp.

An important feature of the present invention is the ease with which the connection can be applied and released without damaging parts not subject to wear and tear during ordinary use of the excavating equipment. For each application or release of the connection, it is necessary to pressurize and depressurize the interior of the hydraulic actuator. Pressurized fluid is supplied via a suitable conduit and nipple 92 into the interior of the actuator.

To facilitate the placement and withdrawal of the hydraulic actuator, and to enable replacement of parts that may become damaged during ordinary use of the excavating equipment, preferably the upper end of the actuator is partially formed by a top plate 120 which has a pair of spaced-apart, horizontal web sections 122. The top plate defines the uppermost end of the main body of the actuator. Pressure fitting 92 includes an elongated, enlarged diameter threaded tubular extension 124 which extends through an open hole in the upper horizontal web 122 of top plate 120 and threadably engages a threaded hole in main hydraulic actuator body portion 126. The pressure fitting includes a convenient hexagonal head which can be used to torque the threaded end of the fitting into the threaded hole in the main body portion to thereby simultaneously secure top plate 120 in place and mount pressure fitting 92 on main actuator body portion 126.

The portion of pressure fitting 92 extending into open end 112 (shown in FIG. 2 only) of the hydraulic actuator is protected against contamination and damage by a strong, preferably a generally solid, rectangularly shaped metal, e.g. steel, cap 128 which is essentially a solid block of steel that has a center bore 130 which is configured to fully accommodate therein the nipple end of the pressure fitting through which pressurized fluid is supplied to the interior cavities of the hydraulic actuator, as is generally illustrated in FIG. 7. Preferably, the space between the pressure fitting and the surrounding walls of center bore 130 receives an elastomeric sleeve (not shown in the drawings) that snugly but removably slips over the nipple of the pressure fitting and otherwise fills up the annular space surrounding the nipple, as can be seen in FIG. 8, to keep contaminants out.

To manually removably secure cap 128 to the hydraulic actuator 52, a spring-biased detent ball 132 is suitably mounted in cap 120 so that the ball slightly protrudes past a side of the cap facing an upstanding wall 134 of actuator top plate 120. Wall 134 has correspondingly spaced-apart depressions 136 for receiving the spring-biased balls 132.

Cap 128 and the matching surfaces of hydraulic actuator 52, and in particular the matching surfaces formed by actuator top plate 120, are dimensioned so that the cap fits snugly but readily movable into open end 112 (shown in FIG. 2). The spring-loaded detent balls 132, however, retain the cap in place during normal use of the excavating equipment. Nevertheless, the cap can be manually removed by pulling it upwardly relative to the hydraulic actuator, which disengages the detent balls from the depressions 136 in the actuator so that the cap can be removed, thereby providing access to the nipple of the pressure fitting 92.

To facilitate the removal of the cap, and in particular to permit ready removal of the cap even if it and/or its surfaces that mate with the remainder of the actuator are heavily contaminated and/or damaged, for example from having suffered heavy blows or impacts against it, upstanding wall 134 of top plate 120 includes a cut-out 138 which defines at a level below the uppermost surface of cap 128 a flat, generally horizontal support surface 138. A recess 142 is formed in the side of cap 128 facing the upstanding wall 134 and straddles support surface 138 so that at least a portion of the recess is located above the support surface when cap 128 is positioned in place. This provides access to the recess from the exterior of connection 24. The cap can be forcibly removed by supporting a suitable prying tool, which can be a heavy-duty flat screwdriver, an L-shaped metal bar with a long grab bar and a short prying end capable of engaging recess 142 in the cap when the bend of the L-shaped member is supported on the horizontal support surface 138, or a similar tool with which the cap can be forced upwardly relative to upstanding actuator wall 134 to pry the cap loose from the actuator and remove it.

Figure 9:
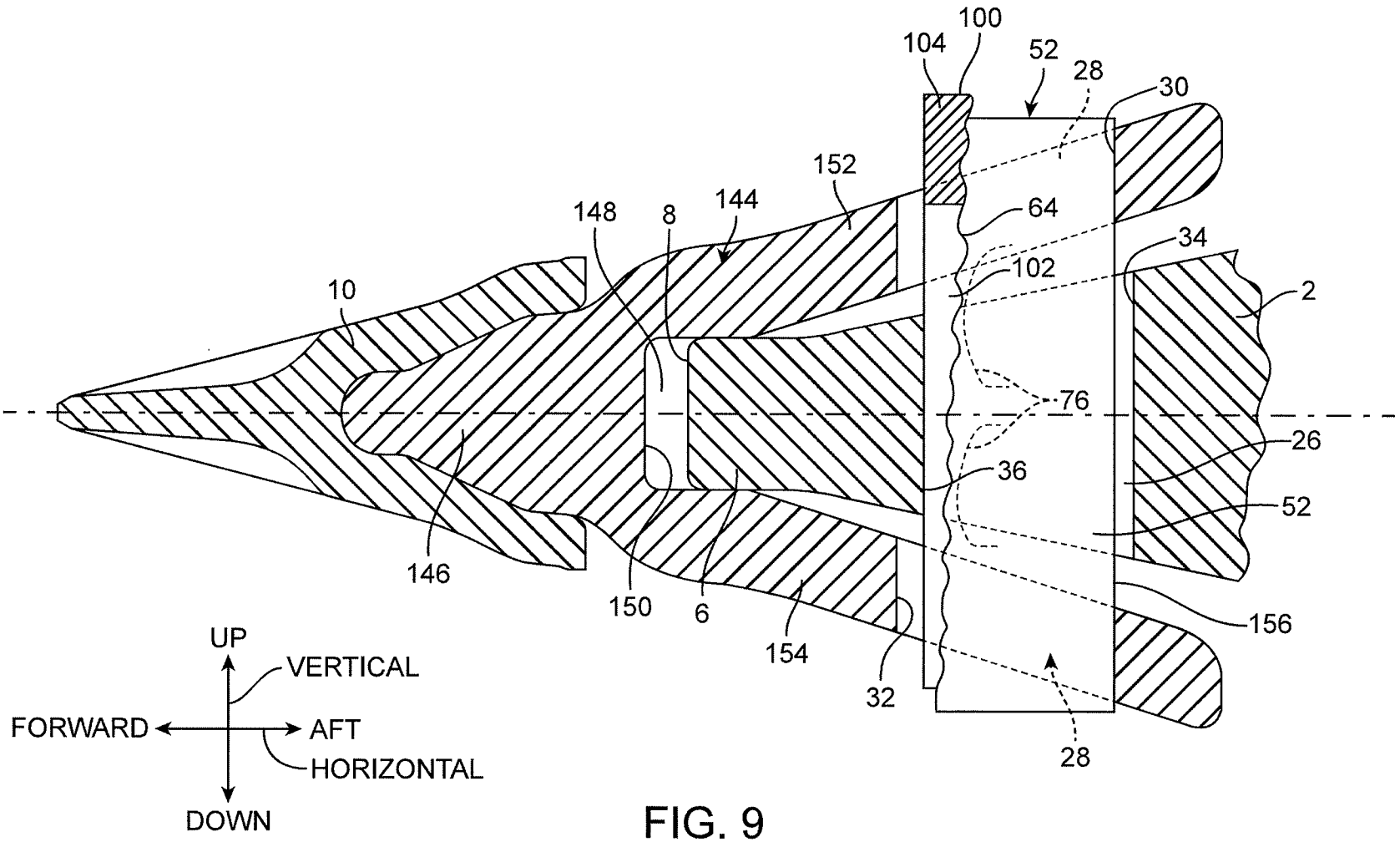
FIG. 9 is a side elevational view, in section, and illustrates an alternative embodiment of the present invention that is particularly suitable for use on dragline buckets.

FIG. 9 shows another embodiment of the present invention which is particularly suitable for use in connection with dragline buckets, and in particular for replacing worn adapters of such buckets.

As is true for the previously described embodiments of the invention, a dragline adapter 144 is positioned over a bucket 2 having a lip 6 that ends in a lip end 8. A forward end of adapter 144 suitably mounts a tooth 10 as seen in FIG. 9.

Adapter 124 has a nose portion 146 that receives the tooth and which has an interior cut-out 148 that snugly engages bucket lip 6 so that lip end 8 is spaced some distance, typically between about ⅛" to ⅜", from a bottom end 150 of the cut-out. If desired, the lip end 8 can also be allowed to extend all the way to the end 150 of the cut-out.

Lip 6 of bucket 2 and upper and lower legs 152, 154 of adapter 144 define an opening 26 in the lip and openings 28 in the adapter which are non-contiguous and generally vertically aligned but horizontally offset so that the forward and aft ends 32, 30 of the openings in the adapter legs are positioned forward of the corresponding forward and aft surfaces 36, 34 of opening 26 in the lip.

A hydraulic actuator 52 constructed as above described and a cooperating wedge 100 are disposed in the generally vertically aligned but horizontally slightly offset openings 26, 28 in the lip and the adapter legs, as is shown in FIG. 9.

When it is desired to secure the adapter to the bucket lip 6, and following the insertion of a hydraulic actuator 52 and a cooperating wedge 104 in the generally aligned openings 26, 28 in the lip and the adapter legs, the hydraulic pistons 76 (only schematically shown in FIG. 9) are energized as above described. Upon energization, the pistons push in a forward direction towards front wall 36 of opening 26 in the lip, while an aft side 156 of the actuator pushes in an aft direction against aft walls 30 of openings 28 in the adapter legs. The resulting force urges the lip and the adapter towards each other. The engagement of the bucket lip 6 by interior adapter cut-out 148 and/or the bottoming out of lip end 8 in the adapter cut-out 148 causes an elastic elongation of the adapter legs under the force exerted by pistons 76. This elongation will typically be most pronounced in those portions of the adapter legs adjacent each side of the openings 28 in the adapter legs, although other portions of the adapter leg will typically be slightly elongated as well. Once the desired elongation has been reached, wedge 100 is manually pushed down until the cooperating undulations 64 on the hydraulic actuator and the wedge prevent further downward movement. Thereafter, the pressure in the hydraulic actuator is reduced or eliminated, which permits the previously elastically elongated portions of the adapter legs to contract until wedge 100 prevents further contracting movements. The engagement of the hydraulic actuator by the edge will maintain the adapter legs in their slightly reduced prestressed state and will prevent the adapter legs from returning to their relaxed state, thereby maintaining the horizontal force which tightens the adapter on the bucket lip, as described in greater detail above.

What is claimed is:

1. A connection for immovably securing an adapter for detachably carrying a replaceable digging tooth at its front end to a lip of an excavating container of excavating equipment, the adapter having an upper leg and a lower leg located proximate respective upper and lower surfaces of the lip, the connection comprising substantially aligned openings in the legs and the lip, engagement sections of the adapter legs traversing the opening in the lip proximate and forward of an aft end thereof, a pressure applying unit arranged inside the openings adapted to generate and release a generally horizontally acting force which draws the adapter and the lip towards each other, a stress member operatively coupled to the pressure applying unit which resiliently deforms relative to its relaxed shape when the stress member is subjected to the horizontally acting force, and a spacer configured to be inserted between the pressure applying unit and the openings while the horizontally acting force resiliently deforms the stress member, the spacer being further shaped so that upon a reduction or cessation of the horizontally acting force the spacer continues to maintain the stress member in a resiliently deformed state in which it draws the adapter and the lip towards each other.

2. A connection according to claim 1 wherein the spacer comprises a wedge which converges in a vertical direction.

3. A connection according to claim 1 wherein the pressure applying unit comprises a hydraulic actuator including at least one piston for generating the horizontally acting force.

4. A connection according to claim 3 wherein the spacer comprises a wedge which converges in a vertical direction and which has a pair of spaced-apart vertical legs, wherein the hydraulic actuator includes a piston which protrudes past the wedge in a generally horizontal direction, and wherein the legs of the wedge straddle the protruding piston.

5. A connection according to claim 4 wherein the wedge is positioned on a side of the hydraulic actuator facing in a forward direction.

6. A connection according to claim 4 wherein the wedge is positioned on a side of the hydraulic actuator facing in a rearward direction.

7. A connection according to claim 1 wherein the stress member comprises portions of the upper and lower legs of the adapter which extend in a rearward direction and which are spaced apart from the respective upper and lower surfaces of the lip from a point proximate a front end of the lip past an aft end of the openings.

8. A connection according to claim 1 wherein the stress member comprises a C-clamp having a main body extending through the openings and spaced-apart, rearwardly projecting arms in engagement with the adapter, the main body defining a front surface that is at least partially disposed inside the openings, a forward facing surface of the main body being subjected to the horizontally acting force generated by the pressure applying unit which resiliently deforms at least a portion of the main body disposed in the openings.

9. A connection according to claim 8 wherein the spacer comprises a wedge which converges in the vertical direction and which is disposed between the pressure applying unit and the main body of the C-clamp.

10. A connection according to claim 3 wherein an interface between the hydraulic actuator and the spacer is defined by opposing surfaces of the hydraulic actuator and the spacer which have cooperating undulations that extend in a generally horizontal direction.

11. A connection according to claim 3 wherein the hydraulic actuator comprises a housing extending through at least a portion of the openings in a generally vertical direction and defining an interior cavity inside of which a hydraulic piston is movable in a generally horizontal direction for placing the stress member in its stressed state, and a pressure conduit extending from the cavity to a vertical end of the housing for pressurizing and depressurizing the cavity and thereby extending the piston out of and retracting it into, respectively, the cavity, and a pressure fitting adapted to be connected to a source of a pressurized fluid communicating with the conduit and extending to an exterior of the housing, and a metal cap extending over the vertical end of the housing which encapsulates the pressure fitting and which is removably secured to the housing for protecting the pressure fitting during use of the container.

12. A connection according to claim 11 including at least one detent member in one of the housing and the cap and a depression cooperating with the detent member in the other one of the housing and the cap, the detent member being biased into the depression when the cap is placed over the vertical end of the housing for retaining the cap on the housing with a force selected so that the cap can be manually removed from the housing to provide access to the pressure fitting.

13. A connection according to claim 12 wherein the housing includes a generally horizontally oriented support surface proximate the vertical end of the housing, wherein the cap extends in a vertical direction past the support surface and defines a cut-out positioned proximate the support surface and shaped to be engaged by a prying tool configured to rest on the support surface while engaging the cut-out so that the cap can be pried off the housing with the prying tool.

14. A connection according to claim 13 including an end plate defining the vertical end of the housing which defines the support surface, has horizontally oriented flanges that engage cooperating grooves in the housing to locate and maintain the end plate in position, and an aperture through which the pressure fitting extends, and wherein the pressure fitting includes a threaded end engaging a cooperating threaded hole in the housing, the pressure fitting, when tightened in the threaded hole, securing the end plate to the housing.

15. A connection for firmly securing an adapter for detachably carrying a replaceable digging tooth at its front end to a lip of an excavating container of excavating equipment, the adapter having an upper leg and a lower leg, the connection comprising substantially aligned openings in the legs and the lip, engagement sections of the adapter legs traversing the opening in the lip proximate and forward of an aft end thereof, the upper and lower legs of the adapter extending from proximate a front end of the lip at inclined angles relative to the respective upper and lower surfaces of the lip so that the opening in the lip and the openings in the adapter legs are non-contiguous, a pressure applying unit arranged inside the openings configured to selectively apply and release a generally horizontally acting force which draws the adapter and the lip towards each other, and a wedge arranged in the openings, converging in a vertical direction, and disposed in the openings between a generally vertically oriented surface of the pressure applying unit and an adjacent wall of the opening, the vertically oriented side of the pressure applying unit and the opposing side of the opening defining a generally wedge-shape, vertically converging space configured to receive the wedge, the pressure applying unit including at least one power-actuated piston that is extendable and retractable in a generally horizontal direction through the wedge-shaped space for applying the generally horizontally acting force to the upper and lower legs of the adapter which enlarges a horizontal extent of the wedge-shaped space and resiliently elongates the upper and lower adapter legs to place the legs in a stressed state, the wedge having a horizontal dimension selected so that when inserted into the enlarged wedge-shaped space while the pressure applying unit applies the horizontally acting force the adapter legs are in their stressed state and so that the adapter legs remain in a stressed state upon a reduction or cessation of the horizontally acting force generated by the pressure applying unit and continue draw the adapter and the lip towards each other and thereby maintain the lip and the adapter in firm, immovable contact with each other.

16. A connection according to claim 15 wherein the excavating container is a dragline bucket of a dragline excavating equipment.

17. A connection for firmly securing an adapter for detachably carrying a replaceable digging tooth at its front end to a lip of an excavating container of excavating equipment, the adapter having an upper leg and a lower leg located adjacent respective upper and lower surfaces of the lip, the connection comprising substantially aligned openings in the legs and the lip, engagement sections of the adapter legs traversing the opening in the lip proximate and forward of an aft end thereof, a C-clamp having a main body extending through the openings and rearwardly extending arms that diverge in an aft direction and define opposing engagement surfaces that are spaced apart to simultaneously contact the engagement sections at locations from respective front and aft ends of the engagement surfaces of the arms while an aft facing side of the main body is spaced from aft ends of the openings in the legs and the lip, a pressure applying unit supported by a front end of the opening in the lip for temporarily applying a releasable force against a forward facing surface of the main C-clamp body and inside the openings, the releasable force being sufficient to resiliently deflect the main body in the aft direction to place the main C-clamp body in a stressed state, causing the engagement surfaces of the arms to spread apart and the main body of the C-clamp to move towards the aft end of the openings, and a spacer between front ends of the openings and a forward facing side of the main C-clamp body preventing a return of the main C-clamp body to its relaxed, unstressed state upon a reduction or cessation of the releasable force for maintaining the main C-clamp body in a stressed state and the C-clamp remains firmly coupled to the adapter and substantially immovably maintains the adapter properly positioned and oriented on the lip.

18. A connection according to claim 17 wherein the pressure applying unit includes an aft facing surface that is spaced apart from and converges in a downward direction toward a forward facing side of the main C-clamp body to define a downwardly converging wedge-shaped space between them, and wherein the spacer comprises a wedge having a substantially vertical aft facing surface engaging the forward facing side of the main C-clamp body and a forward facing surface converging relative to its aft facing surface of the wedge at an angle complementary to an angle of the downwardly converging aft surface of the pressure applying unit, the wedge being further configured to maintain the main C-clamp body in its stressed state in which it draws the adapter and the lip towards each other.

19. A connection according to claim 17 including horizontally, matching undulations defined by the aft facing surface of the pressure applying unit and the front facing surface of the wedge preventing the wedge from moving in a vertical direction out of the wedge-shaped space while the main C-clamp body remains in the stressed state.

20. A method for replacing a worn adapter configured for carrying a digging tooth at its front end, the adapter being removably mounted on a lip of an excavating container of excavating equipment, the adapter having an upper leg and a lower leg located proximate respective upper and lower surfaces of the lip and an end section between the legs placed over a front edge of the lip, the legs and the lip defining substantially aligned openings and engagement sections of the adapter legs traversing the opening in the lip proximate aft and forward of an aft end thereof, the connection being formed by a C-clamp including the main body extending through the aligned openings and arms extending from the main body in an aft direction and engaging the adapter, a wedge-shaped space extending through the openings between an end of the hole and the C-clamp, and a wedge disposed in the wedge-shaped space and engaging opposing sides of the C-clamp and maintaining the C-clamp and the adapter in firm contact with each other in a state in which the main body of the C-clamp is resiliently prestressed and generates a generally horizontally acting force which draws the adapter and the lip towards each other, the method comprising applying a generally horizontal force against the main body of the C-clamp to increase the amount of prestress in the main body, resiliently enlarge the wedge-shaped space in a horizontal direction and loosen the wedge in the wedge-shaped space relative to the C-clamp, withdrawing the wedge from the wedge-shaped space while the generally horizontal force is applied against the main body of the C-clamp, and thereafter disengaging the C-clamp from the worn adapter and removing the worn adapter from the lip, replacing the worn adapter with a fresh adapter and aligning the openings in the fresh adapter and the lip, reengaging the arms of a C-clamp and a portion of the adapter, reapplying the generally horizontal force against the main body of the C-clamp to again prestress the main body of the C-clamp and increase the width of the wedge-shaped space, thereafter inserting a wedge into the wedge-shaped space while the horizontal force is applied against the main body of the C-clamp, and thereafter discontinuing applying the generally horizontal force against the main body of the C-clamp so that the wedge continues to apply a generally horizontal force against the main body of the C-clamp to maintain the C-clamp in a prestressed state.

21. A method according to claim 20 wherein the C-clamp, the spacer and the wedge forming the connection between the fresh adapter and the lip are the same C-clamp, spacer and wedge that were previously used to connect the worn adapter to the lip.

22. A method according to claim 20 including interlocking the spacer and the wedge in response to discontinuing applying the force to prevent the wedge and the spacer from moving relative to each other in the direction of the openings as long as the main C-clamp body remains in its stressed state.

* * * * *